US006009806A

United States Patent [19]

Motoe et al.

[11] Patent Number: 6,009,806

[45] Date of Patent: Jan. 4, 2000

[54] INK SUPPLY CONSTRUCTION OF PRINTER HAVING INK INTERRUPTING MEMBER

[75] Inventors: Katsuro Motoe; Koji Nakayama, both of Ibaraki-ken, Japan

[73] Assignee: Riso Kagaku Corporation, Toyota, Japan

[21] Appl. No.: 09/136,760

[22] Filed: Aug. 19, 1998

[30] Foreign Application Priority Data

Aug. 22, 1997 [JP] Japan ..... 9-242215

[51] Int. Cl.[7] ..... B41L 13/00

[52] U.S. Cl. ..... 101/120; 101/116

[58] Field of Search ..... 101/114, 116, 101/119, 120

[56] References Cited

U.S. PATENT DOCUMENTS

| | | | |
|---|---|---|---|
| 3,312,165 | 4/1967 | Strom . | |
| 4,385,558 | 5/1983 | Takahashi et al. | 101/120 |
| 5,657,691 | 8/1997 | Kato | 101/120 |

FOREIGN PATENT DOCUMENTS

| | | |
|---|---|---|
| 0 673 777 | 9/1995 | European Pat. Off. . |
| 409951 | 2/1925 | Germany . |
| 55-55889 | 4/1980 | Japan . |
| 60-4062 | 1/1985 | Japan . |
| 61-22655 | 2/1986 | Japan . |
| 8-282079 | 10/1996 | Japan . |
| 2 158 011 | 11/1985 | United Kingdom . |

*Primary Examiner*—Ren Yan
*Attorney, Agent, or Firm*—Oliff & Berridge, PLC

[57] ABSTRACT

In the ink supply construction of a stencil printer, having an ink holding space 14 defined by an outer circumferential surface of an ink supply roller 4 and an ink supply control member 8, there is provided an ink interrupting member 30 as opposed to the ink supply control member across the ink holding space for restricting a side of the ink holding space opposite to the ink supply control member, in order to stabilize and highly uniformalize the cross sectional size of a rotating lump of ink L formed in the ink holding space along the length of the lump of ink. The lump of ink may be rotationally driven by an ink driving rod member 15 provided in the ink holding space. When the lump of ink is not rotationally driven by the ink driving rod member, the ink interrupting member may be constructed to rotationally drive the lump of ink.

5 Claims, 6 Drawing Sheets

INK SUPPLY CONSTRUCTION OF PRINTER HAVING INK INTERRUPTING MEMBER

BACKGROUND OF THE INVENTION

1. Field of the Invention

The present invention relates to a printer, and more particularly to an ink supply construction of a stencil printer.

2. Description of the Prior Art

As an ink supply construction of a stencil printer, there has been proposed by Japanese Patent Application 53-128043 (Laid-open Publication 55- 55889) by the same assignee as that of the present application such an ink supply construction of a stencil printer that comprises a frame including a pair of mutually opposing side plates, an ink supply roller supported by the frame between the pair of side plates to rotate about a central axis thereof with an outer circumferential surface thereof slidably contacting an inner circumferential surface of the printing drum of the printer, and an ink supply control member supported by the frame between the pair of side plates to extend along a generatrix of the ink supply roller so as to define a wedge-shaped ink holding space converging to an ink metering clearance together with an outer circumferential surface of the ink supply roller, so that the ink supplied to the ink holding space is formed into a lump of ink rotating in the ink holding space llike a vortex conforming to the moving direction of the outer circumferential surface of the ink supply roller, with the ink of the lump being transferred through the ink metering clearance according to the rotation of the ink supply roller as adhered to the outer circumferential surface thereof.

Further, it has been proposed by Japanese Patent Application 58-113850 (Laid-open Publication 60-4062) filed by the same assignee as that of the present application to dispose an ink driving rod member in the ink holding space to extend along a generatrix of the ink supply roller and the ink supply control member and to rotate around a central axis thereof in synchronization with the rotation of the ink supply roller in a rotational direction opposite to that of the ink supply roller, in order to intensify the vortex-like rotation of the lump of ink formed in the ink holding space.

Still further, it has been proposed by Japanese Utility Model Application 59-107284 (Laid-open Publication 61-22655) by the same assignee as that of the present application to form the ink driving rod member such that it has a larger cross section in axially opposite end portions thereof than in an axially central portion thereof, in view of a phenomenon that a lump of ink rotating like a vortex in the ink holding space tends to have a larger cross section in the axially opposite end portions than in the axially central portion due to the fact that the axially opposite end portions are more decelerated than the axially central portion by a frictional contact with the pair of side plates.

In each of the above-mentioned formerly proposed ink supply constructions, the lump of ink rotating in the ink holding space like a vortex is formed by the ink pressurized by an ink pump and discharged from a plurality of ink outlet ports disposed above the ink holding space as distributed therearound, with the size of its cross section being maintained within a predetermined range by the ink pump being controlled by a control means in response to an output of an ink sensor for detecting the cross sectional size of the lump of ink. In more detail, when the cross sectional size of the lump of ink decreases below a predetermined value according to a discharge of the ink from the ink holding space along with the rotation of the ink supply roller accompanying the rotation of the printing drum during a printing, the reduction of the cross sectional size is detected by the ink sensor of a contacting or non-contacting type, whereupon the ink pump is operated by the control means so as to supplement ink to the ink holding space, and when an increase of the cross sectional size of the lump of ink is detected by the ink sensor after a lapse of time of the supplement of ink, the operation of the ink pump is stopped by the control means. By such an intermittent operation of the ink pump by the control means accompanied by the ink sensor, the cross sectional size of the lump of ink in the ink holding space is maintained to be substantially constant during the operation of the ink supply construction.

However, since the supply of ink to the ink holding space is made by a plurality of ink outlet ports arranged as spaced along the ink holding space, during a period in which the ink is being discharged from the ink outlet ports and a little while after the stop of the supply of ink the cross sections of the lump of ink at and around the portions thereof corresponding to the ink outlet ports are larger than those of the other portions, so that, even by an improvement available by the above-mentioned Japanese Patent Application 55-113850 and Japanese Utility Model Application 59-107284, the cross sectional size of the lump of ink is still not uniform along its length, thereby threatening a generation of non uniform thickness of the printed image in the direction of width of the paper. Further, since the ink sensor detects the cross sectional size of only a portion of the lump of ink along the length thereof, there inevitably occurs a discrepancy between the amount of ink supplied to the ink holding space and the amount of ink detected by the ink sensor, such a discrepancy becoming greater as the speed of supply of ink, i.e., the speed of consumption of ink, increases.

Since the wedge-shaped cross section of the ink holding space defined between the outer circumferential surface of the ink supply roller and the ink supply control member is opened relatively widely upward, with its lower edge defined by the outer circumferential surface of the ink supply roller swiftly approaching to being horizontal as being more distant from the tip end of the wedge, in the conventional ink supply construction the outer circumferential surface of the ink supply roller defining the lower edge of the wedge-shaped ink holding space or the lower wall thereof has substantially no function of preventing a lateral expansion of the cross sectional shape of the lump of ink so as to restrict an excessive local growth of the lump of ink not even along the length thereof.

SUMMARY OF THE INVENTION

In view of such problems that the lateral side of the ink holding space opposite to the ink supply control member is almost open, so that the uniformity of the cross section of the lump of ink formed in the ink holding space along the length thereof is not always sufficient, particularly when the printer is started, even more when the printer is started after a relatively long time stoppage, even when the ink driving rod member is additionally disposed in the ink holding space according to the above-mentioned Japanese Patent Application 58-113850, or further even when the cross sectional size of the ink driving rod member is modified along the length thereof according to the above-mentioned Utility Model Application 59-107284, thereby causing a large non uniformity or a local excessive growth in the cross sectional size of the lump of ink in the ink holding space, it is a primary object of the present invention to abolish the conventional concept of defining the ink holding space only by the outer circumferential surface of the ink supply roller and the ink supply control member except the opposite axial ends thereof, so that the cross sectional shape of the ink holding space is defined by the outer circumferential surface of the ink supply roller, the ink supply control member, and further an ink interrupting member disposed between the pair of side plates to extend along a generatrix of the ink supply roller in close proximity to the outer circumferential surface thereof as opposed to the ink supply control member in parallel thereto across the ink holding space, so as to contact a circumferential part of the lump of ink formed in the ink holding space, for restricting a lateral expansion of the cross section of the lump of ink, so that thereby the cross sectional shape of the lump of ink is more uniformized along the length thereof through all period of operation of the printer, including the starting time, while also stably holding the lump of ink in the ink holding space during a stoppage of the printer.

According to the present invention, the above-mentioned primary object is accomplished by an ink supply construction of a printer, comprising a frame including a pair of mutually opposing side plates, an ink supply roller supported by the frame between the pair of side plates to rotate about a central axis thereof with an outer circumferential surface thereof slidably contacting an inner circumferential surface of a printing drum of the printer, an ink supply control member supported by the frame between the pair of side plates to extend along a generatrix of the ink supply roller so as to define an ink holding space converging to an ink metering clearance together with an outer circumferential surface of the ink supply roller, and an ink driving rod member disposed in the ink holding space to extend along a generatrix of the ink supply roller and the ink supply control member to rotate around a central axis thereof in synchronization with rotation of the ink supply roller in a rotational direction opposite to that of the ink supply roller, wherein the ink supply construction further comprises an ink interrupting member disposed between the pair of side plates to extend along a generatrix of the ink supply roller in close proximity to the outer circumferential surface thereof as opposed to the ink supply control member in parallel thereto across the ink holding space so as to contact a circumferential part of a lump of ink formed in the ink holding space for restricting a lateral extension of a cross section of the lump of ink.

Or alternatively, the above-mentioned primary object is accomplished according to the present invention by an ink supply construction of a printer, comprising a frame including a pair of mutually opposing side plates, an ink supply roller supported by the frame between the pair of side plates to rotate about a central axis thereof with an outer circumferential surface thereof slidably contacting an inner circumferential surface of a printing drum of the printer, and an ink supply control member supported by the frame between the pair of side plates to extend along a generatrix of the ink supply roller so as to define an ink holding space converging to an ink metering clearance together with an outer circumferential surface of the ink supply roller, wherein the ink supply construction further comprises an ink interrupting member disposed between the pair of side plates to extend along a generatrix of the ink supply roller in close proximity to the outer circumferential surface thereof as opposed to the ink supply control member in parallel thereto across the ink holding space so as to contact a circumferential part of a lump of ink formed in the ink holding space for restricting a lateral extension of a cross section of the lump of ink, the ink interrupting member being rotated around a central axis thereof in synchronization with the rotation of the ink supply roller in a rotational direction same to that of the ink supply roller.

When the ink holding space is defined as described above such that the ink holding space is defined also by the ink interrupting member in addition to the conventional outer circumferential surface of the ink supply roller and the ink supply control member, the cross sectional shape of the ink holding member is more approached to the shape of U to be more restricted than in the conventional ink supply construction. Since the lump of ink in the ink holding space rotates like a vortex, when the lump of ink in the ink holding space is rotationally driven only by a frictional contact with the outer circumferential surface of the ink supply roller, it is apprehended that the rotation of the lump of ink is lowered to an undesirable level by a frictional contact of the lump of ink with the ink interrupting member. However, when the lump of ink is rotationally driven by the ink driving rod member in addition to the rotational driving by the outer circumferential surface of the ink supply roller, it is possible to maintain the rotation of the lump of ink at a sufficiently desirable level even when the lump of ink contacts the ink interrupting member constructed as a stationary member.

On the other hand, when the ink interrupting member is constructed as a rod member having a circular cross section and rotationally driven to rotate around a central axis thereof in synchronization with the rotation of the ink supply roller in the rotational direction same to that of the ink supply roller, the ink interrupting member operates not only as a means for restricting a lateral expansion of the cross section of the lump of ink but also as a means for rotationally driving the lump of ink, so that in such a construction the lump of ink is rotated at a sufficient level of rotation in the ink holding space defined by the outer circumferential surface of the ink supply roller, the ink supply control member and the ink interrupting member, without the ink driving rod member.

The ink driving rod member may of course be provided in the above-mentioned construction in which the ink interrupting member is operated also as an ink driving means.

BRIEF DESCRIPTION OF THE DRAWINGS

In the accompanying drawings.

DESCRIPTION OF THE EMBODIMENTS

In the following, the present invention will be described in more detail with respect to some embodiments thereof.

Figure 1:
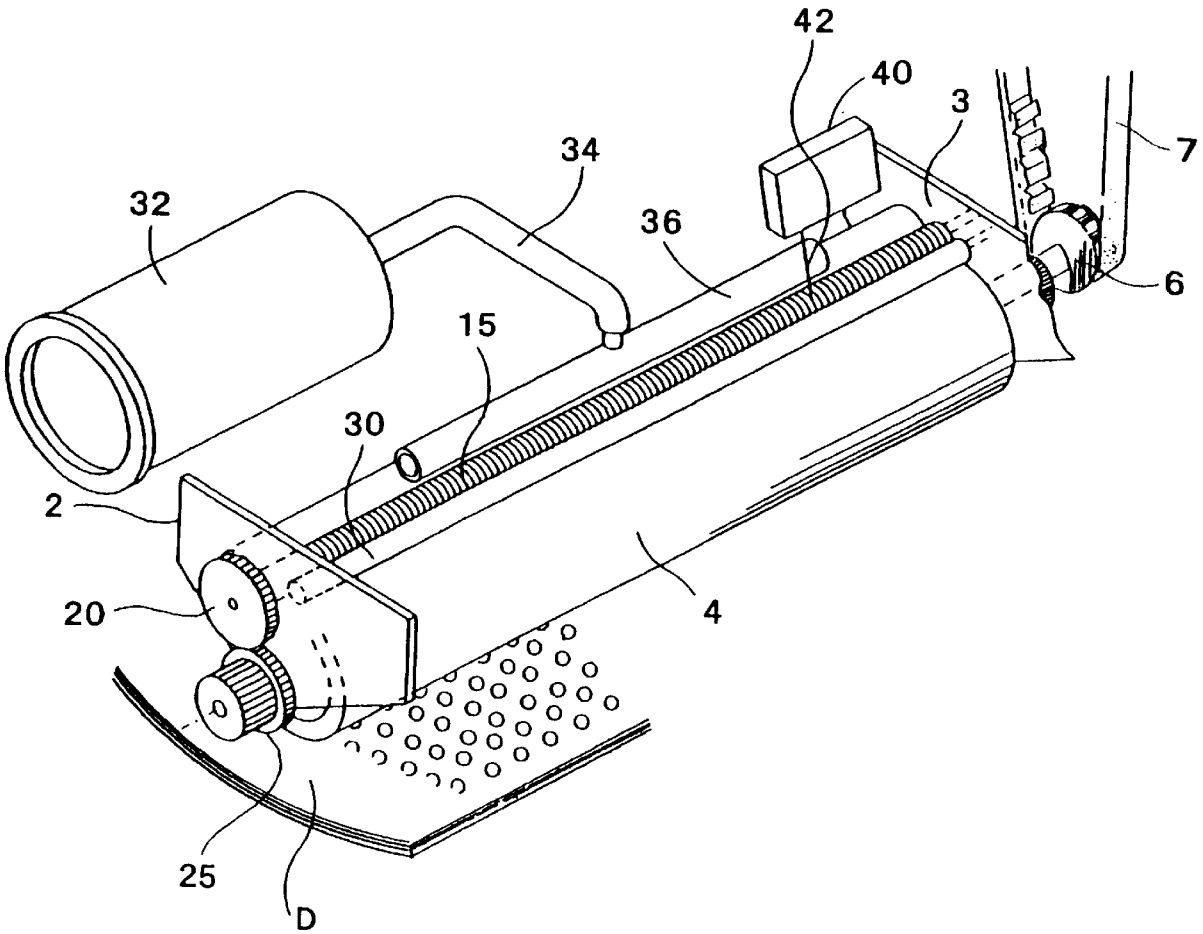
FIG. 1 is a perspective view showing essential portions of the first embodiment of the ink supply construction according to the present invention.
Figure 2:
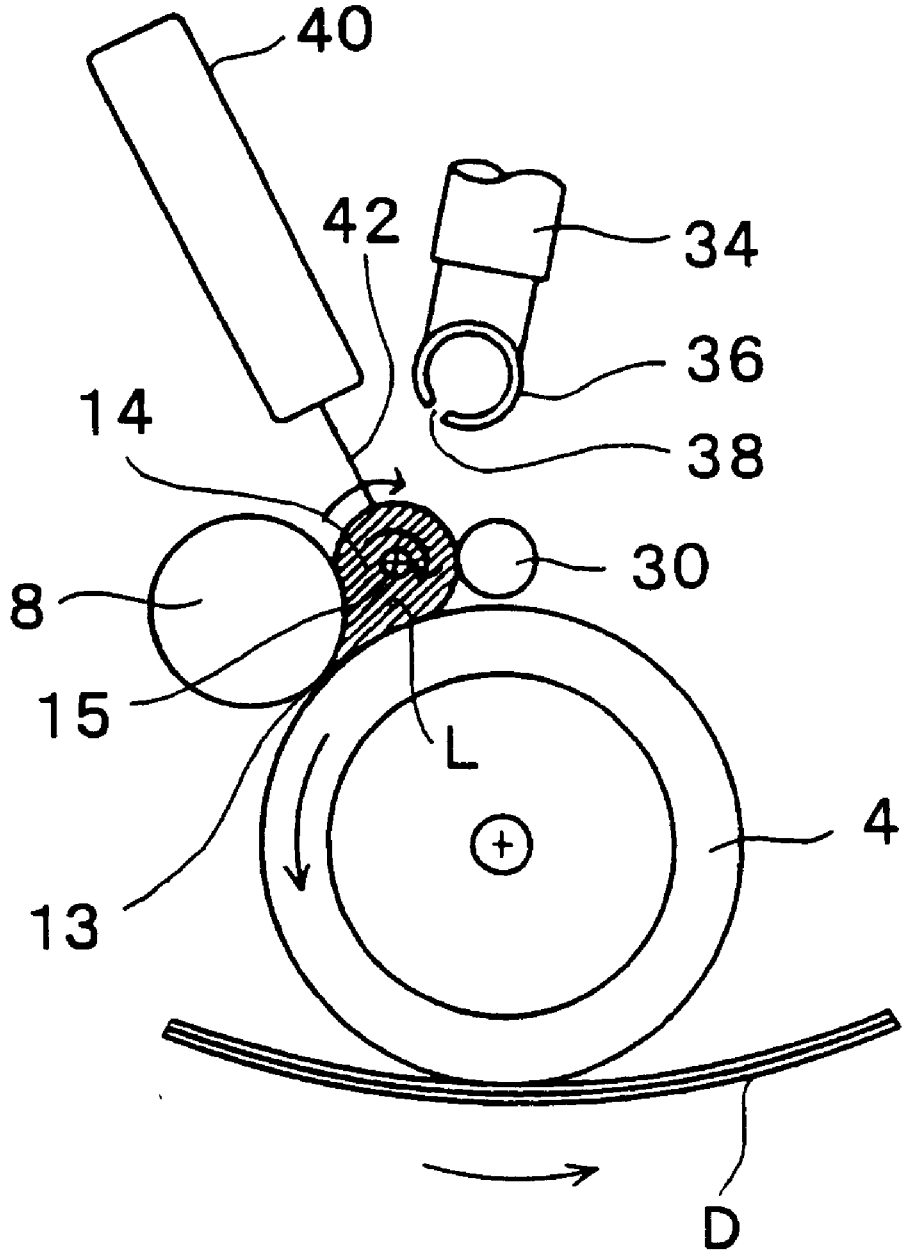
FIG. 2 is a cross sectional view of the essential portions of the embodiment shown in FIG. 1.

Referring to FIG. 1 showing essential portions of the ink supply construction according to the present invention in a perspective view, similar to FIG. 1 of the above-mentioned Japanese Patent Laid-open Publication 60-4062, and FIG. 2 showing the essential portions in a cross sectional view, 2 and 3 are a pair of side plates supported by a frame (not shown) of the ink supply construction, while 4 is an ink supply roller disposed between the pair of side plates to rotate along a central axis thereof. The outer circumferential surface of the ink supply roller is in contact with an inner circumferential surface of a printing drum D. Between the side plates 2 and 3, in parallel with the ink supply roller 4, i.e. along a generatrix thereof, an ink supply control member (doctor rod) 8 is provided so as to define a predetermined ink metering clearance 13 together with the outer circumferential surface of the ink supply roller, thereby defining an ink holding space 14 between the outer circumferential surface of the ink supply roller 4 and the ink supply control member 8, the ink holding space being wedge shaped to open upward, while converging to the ink metering clearance 13. In the ink holding space 14, an ink driving rod member 15 is disposed to extend along the ink supply control member 8 and a generatrix of the ink supply roller 4 between the side plates 2 and 3. The ink driving rod member 15 carries a gear wheel 20 at one end thereof meshed with a gear wheel 25 provided at one end of the ink supply roller 4, so that the ink driving rod member is rotationally driven in synchronization with the rotation of the ink supply roller 4. The ink supply roller 4 is rotationally driven in the counter-clockwise direction as viewed in FIG. 2 by a pulley 6 provided at the other end thereof being driven by an endless belt 7. The printing drum D is driven around a central axis thereof in the direction shown by an arrow in FIG. 2.

As opposed to the ink supply control member 8 across the ink holding space 14, there is provided an ink interrupting member 30 to extend between the side plates 2 and 3 in parallel with the ink supply control member 8 and a generatrix of the ink supply roller 4 in close proximity to the outer circumferential surface of the ink supply roller. In the embodiment shown in FIGS. 1 and 2, the ink interrupting member 30 is fixed to the side plates 2 and 3 at opposite ends thereof.

By the outer circumferential surface of the ink supply roller 4, the ink supply control member 8 and the ink interrupting member 30, the ink holding space 14 is defined to have a cross section close in its shape to a rectangular groove having a bottom wall and opposite side walls. During the operation of the printer, i.e. when the ink supply roller 4 is rotating, a lump of ink L having a cross section as shown in FIG. 2 is formed to rotate around the ink driving rod member 15. The ink for forming the lump of ink is supplied by an ink supply system including an ink pump 32, an ink conduit 34 and an ink distribution pipe 36 formed with a plurality of ink outlet ports 38 distributed along the length thereof. The supply of the ink to the ink holding space 14 by the ink supply system is controlled by an ink pump operation control means (not shown in the figure) in response to an output signal of an ink sensor 40 having a feeler 42, such that during an operation of the printer, i.e., generally when a power switch of the printer is put on, the ink pump 32 is driven when the feeler 42 of the ink sensor 40 is not touching the lump o ink L, so as to supply ink to the ink holding space 14, thereby increasing the cross sectional size of the lump of ink L until it reaches a predetermined size, and when an attainment of the size is detected by the feeler 42 of the ink sensor 40 touching the lump of ink, the operation of the ink pump 32 is stopped. By such an arrangement, a generally constant cross sectional size of the lump of ink is maintained in the ink holding space 14 throughout the operation of the printer, including a first period during which the ink is consumed according to the rotation of the printing drum and a second period during which the printing drum is standing ready to rotate for printing. Since such an on-off control for intermittently operating a fluidal material supply system depending upon a detection of an accumulated amount of the fluidal material such as ink and others is well known since long ago, and since it is also well known since lone ago to endow such an on-off control based upon a sensor with a performance of an appropriate hysteresis so that the on-off operation of the supply system does not occur too frequently, further detailed descriptions about such a control will be omitted in order to avoid a redundancy of the descriptions and the drawings.

In the embodiment shown in FIGS. 1 and 2, the ink interrupting member 30 is constructed as a rod member having a circular cross section, whereby it contacts a part of the circumferential surface of the lump of ink L circulating in the ink holding space 14 like a vortex around the ink driving rod member 15, so that the contact to the lump of ink L by the ink interrupting member is made only lineally in a relatively small area, thereby restricting horizontal expansion of the lump of ink L under a relatively small frictional resistance.

Figure 3:
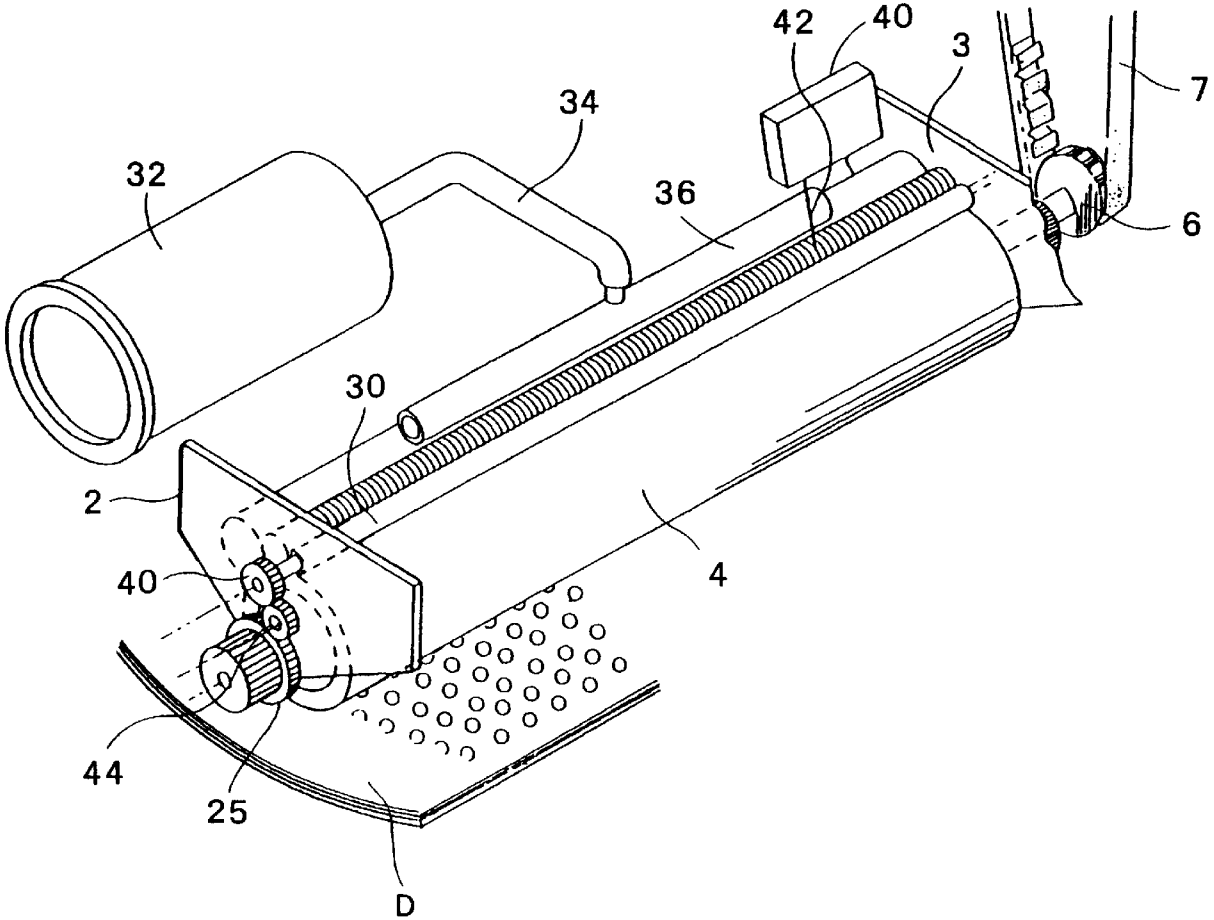
FIG. 3 is a perspective view showing essential portions of the second embodiment of the ink supply construction according to the present invention.
Figure 4:
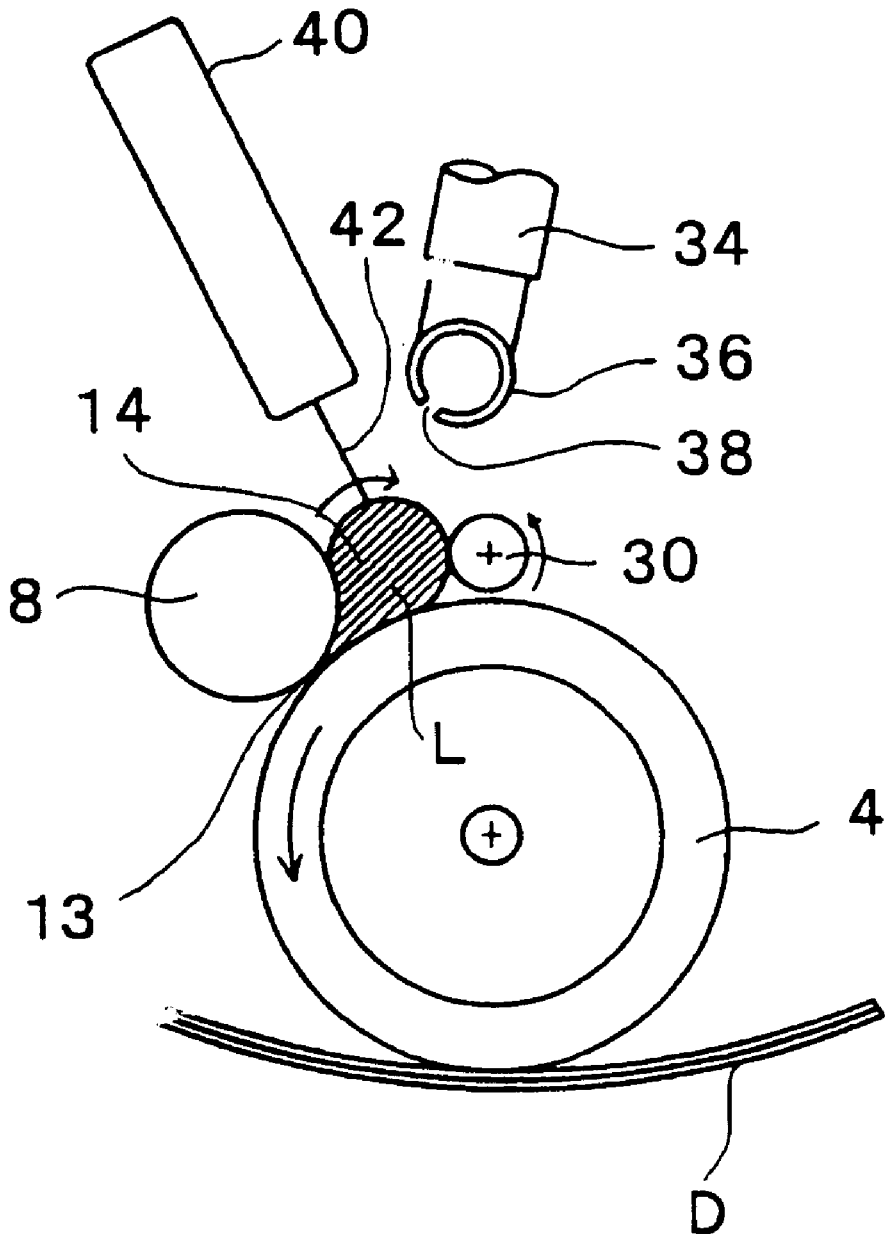
FIG. 4 is a cross sectional view of the essential portions of the embodiment shown in FIG. 3.

FIGS. 3 and 4 are perspective and sectional views similar to FIGS. 1 and 2, respectively, showing a second embodiment of the ink supply construction according to the present invention. In FIGS. 3 and 4, the portions corresponding to those shown in FIGS. 1 and 2 are designated by the same reference numerals. In the embodiment shown in FIGS. 3 and 4, the ink driving rod member 15 in the first embodiment of FIGS. 1 and 2 is omitted, and instead, the ink interrupting member 30 is rotated in the same direction as the ink supply roller 4 in synchronization therewith, by a gear wheel 40 provided at one end thereof is driven by a gear wheel 25 provided at one end of the ink supply roller 4 via an intermediate gear wheel 44. By such an arrangement, the ink interrupting member 30 rotates the lump of ink L around a central axis thereof in the clockwise direction as viewed in FIG. 4 in cooperation with the ink supply roller 4, while contacting a part of the circumferential surface of the lump of ink L in a relatively small linear surface. Therefore, the lump of ink L is given a required rotation force by the frictional contact with the outer circumferential surface of the ink supply roller 4 and the ink interrupting member 30, with no need of rotation force being given from the ink driving rod member 15 as in the first embodiment. It will be apparent that the ink interrupting member 30 restricts a horizontal expansion of the cross section of the lump of ink L, so as to uniformalize the cross sectional shape of the lump of ink L along the entire lengthwise region thereof.

Figure 5:
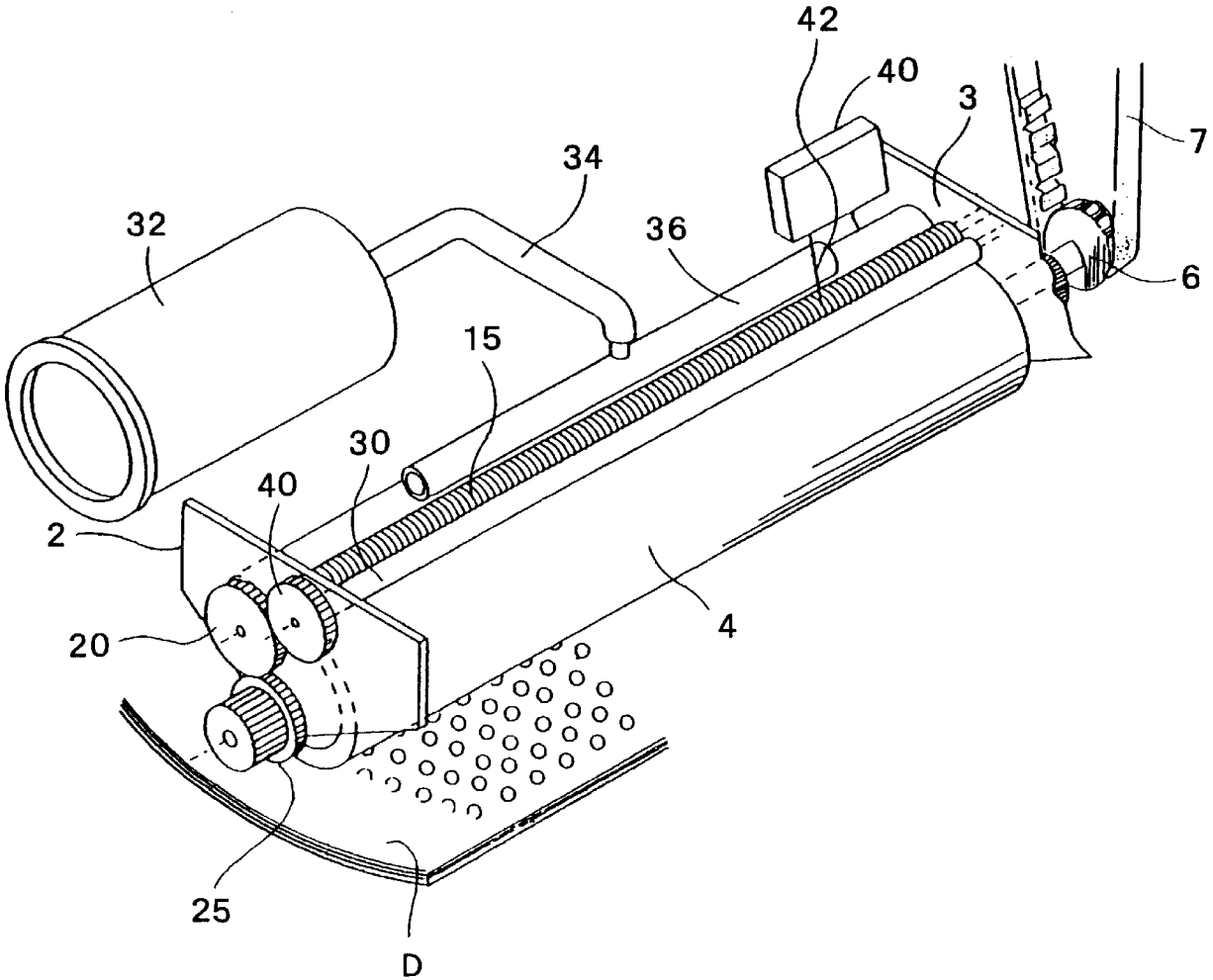
FIG. 5 is a perspective view showing essential portions of the third embodiment of the ink supply construction according to the present invention.
Figure 6:
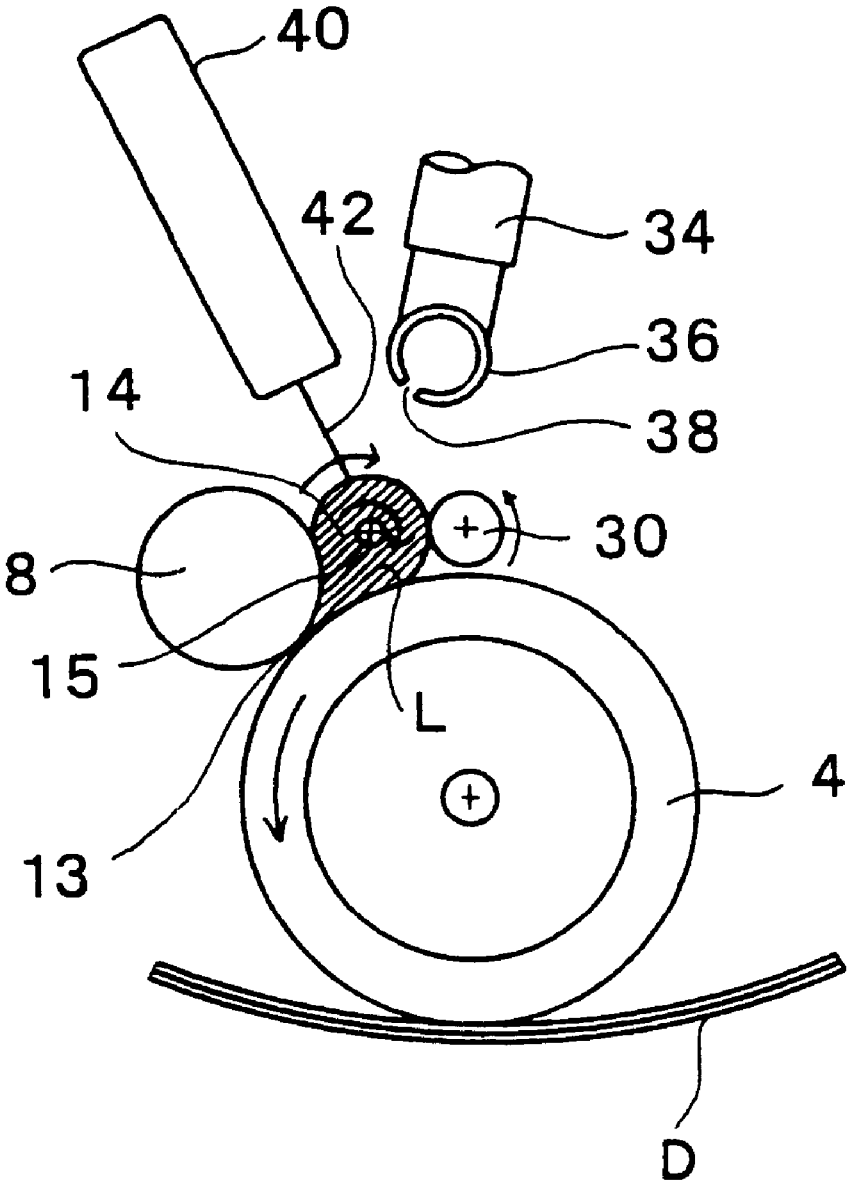
FIG. 6 is a cross sectional view of the essential portions of the embodiment shown in FIG. 5.

FIGS. 5 and 6 are perspective and cross sectional views similar to FIGS. 1 and 2 as well as FIGS. 3 and 4, respectively, showing a third embodiment of the ink supply construction according to the present invention. In FIGS. 5 and 6, the portions corresponding to those shown in FIGS. 1–4 are designated by the same reference numerals. In this embodiment, the ink driving rod member 15 is provided in the same manner as in the embodiment shown in FIGS. 1 and 2, while the ink interrupting member 30 constructed as a rod member having a circular cross section is rotated in synchronization with the rotation of the ink supply roller 4 in the same manner and the same rotational direction as in the second embodiment shown in FIGS. 3 and 4. The two rotational members are driven by gear wheels 20 and 40, respectively, based upon a power transmitted from the gear wheel 25. In this embodiment, the lump of ink L in the ink holding space 14 is driven to form a vortex by three of the outer circumferential surface of the ink supply roller 4, the ink driving rod member 15 and the ink interrupting member 30. It will be apparent that the ink interrupting member 30 of this embodiment restricts a horizontal expansion of the cross section of the lump of ink L in the same manner as in the first and second embodiments.

According to the present invention, the cross sectional shape of the lump of ink L formed in the ink holding space is restricted at a bottom portion and opposite side portions, so that even when the supply of ink to the ink holding space 14 by the ink supply system 32–38 is somewhat irregular along the length of the ink holding space, the cross sectional shape of the lump of ink L formed in the ink holding space 14 is highly uniformalized along the length of the lump of ink, even in a starting period during which such irregularity is generally high.

Although the present invention has been described in detail with respect to three embodiments thereof, it will be apparent for those skilled in the art that various modifications are possible with respect to those embodiments within the scope of the present invention.

What is claimed is:

1. An ink supplier of a printer having a printing drum, comprising:

a frame including a pair of mutually opposing side plates;

an ink supply roller supported by the frame between the pair of side plates to rotate about a central axis thereof, an outer circumferential surface of the ink supply roller slidably contacting an inner circumferential surface of the printing drum of the printer;

an ink supply control member supported by the frame between the pair of side plates and extending along a generatrix of the ink supply roller, thereby defining an ink holding space converging to an ink metering clearance with the outer circumferential surface of the ink supply roller;

an ink driving rod member disposed in the ink holding space and extending along a generartrix of the ink supply roller, the ink driving rod member rotating around a central axis thereof in synchronization with a rotation of the ink supply roller, the ink driving rod member rotating in a direction opposite to a direction of rotation of the ink supply roller; and an ink interrupting member disposed between the pair of side plates and extending along a generatrix of the ink supply roller proximate to the outer circumferential surface of the ink supply roller, the ink interrupting member being opposite to and parallel with the ink supply control member relative to the ink holding space and being substantially the same length as that of said ink supply roller, the ink interrupting member contacting a circumferential part of a lump of ink formed in the ink holding space, thereby restricting a lateral extension of a cross section of the lump of ink.

2. An ink supplier according to claim 1, wherein the ink interrupting member is a rod member having a circular cross section.

3. An ink supplier according to claim 2, wherein the ink interrrupting member rotates around a central axis thereof in synchronization with the rotation of the ink supply roller, the ink interrupting member rotating in a direction same as the direction of rotation of the ink supply roller.

4. An ink supplier according to claim 3, wherein the ink supply roller, the ink driving rod member and the ink interrupting member each a gear wheel at one axial end thereof, the gear wheel of the ink interrupting member meshing with the gear wheel of the ink driving rod member, while the gear wheel of the ink driving rod member meshes with the gear wheel of the ink supply roller, so that the gear wheel of the ink interrupting member is rotationally driven by the gear wheel of the ink driving rod member, while the gear wheel of the ink driving rod member is rotationally driven by the gear wheel of the ink supply roller.

5. An ink supply construction of a printer, comprising a frame including a pair of mutually opposing side plates, an ink supply roller supported by the frame between the pair of side plates to rotate about a central axis thereof with an outer circumferential surface thereof slidably contacting an inner circumferential surface of a printing drum of the printer, and an ink supply control member supported by the frame between the pair of side plates to extend along a generatrix of the ink supply roller so as to define an ink holding space converging to an ink metering clearance together with an outer circumferential surface of the ink supply roller, wherein the ink supply construction further comprises an ink interrupting member disposed between the pair of side plates to extend along a generatrix of the ink supply roller in close proximity to the outer circumferential surface thereof as opposed to the ink supply control member in parallel thereto across the ink holding space so as to contact a circumferential part of a lump of ink formed in the ink holding space for restricting a lateral extension of a cross section of the lump of ink, the ink interrupting member being rotated around a central axis thereof in synchronization with the rotation of the ink supply roller in a rotational direction same to that of the ink supply roller.

* * * * *